US005862608A

United States Patent [19]

Kotitschke

[11] Patent Number: 5,862,608

[45] Date of Patent: Jan. 26, 1999

[54] MOISTENING APPARATUS

[75] Inventor: Herbert Kotitschke, Steinheim, Germany

[73] Assignee: Voith Sulzer Papiermaschinen GMBH, Heidenhein, Germany

[21] Appl. No.: 900,474

[22] Filed: Jul. 25, 1997

[30] Foreign Application Priority Data

Jul. 27, 1996 [DE] Germany ..... 196 30 446.6

[51] Int. Cl.[6] ..... F26B 3/00; D06F 58/00

[52] U.S. Cl. ..... 34/117; 34/446

[58] Field of Search ..... 34/117, 120, 114, 34/116, 115, 446, 454

[56] References Cited

U.S. PATENT DOCUMENTS

| | | | |
|---|---|---|---|
| 4,474,643 | 10/1984 | Lindblad | 162/195 |
| 4,513,516 | 4/1985 | Bjornberg | 34/266 |
| 5,015,336 | 5/1991 | Roerig et al. | 162/369 |
| 5,067,402 | 11/1991 | Marx | 101/226 |
| 5,147,508 | 9/1992 | Sweet | 162/279 |
| 5,232,554 | 8/1993 | Kotitschke | 162/193 |
| 5,248,390 | 9/1993 | Fissmann et al. | 162/193 |
| 5,360,660 | 11/1994 | Nohlgren | 428/229 |
| 5,377,428 | 1/1995 | Clark | 34/446 |
| 5,511,712 | 4/1996 | Holm et al. | 226/11 |
| 5,557,860 | 9/1996 | Kotitschke et al. | 34/455 |
| 5,569,358 | 10/1996 | Cameron | 162/117 |
| 5,587,052 | 12/1996 | Autio et al. | 162/273 |
| 5,591,305 | 1/1997 | Cameron | 162/117 |
| 5,595,632 | 1/1997 | Macierewicz | 162/277 |

FOREIGN PATENT DOCUMENTS

| | | |
|---|---|---|
| 2938244 | 4/1980 | Germany . |
| 9414963 | 12/1994 | Germany . |

*Primary Examiner*—William C. Doerrler
*Attorney, Agent, or Firm*—Greenblum & Bernstein, P.L.C.

[57] ABSTRACT

Machine for manufacturing a web that may include a dryer section having a plurality of dryer cylinders and a plurality of guide rolls, a transport belt that guides the web through the dryer section in a meandering path, a moistening apparatus, and a controlling device. The controlling device may include a device for detecting a web break and a device that activates the moistening apparatus to cool the dryer cylinders in response to the detected web break.

24 Claims, 1 Drawing Sheet

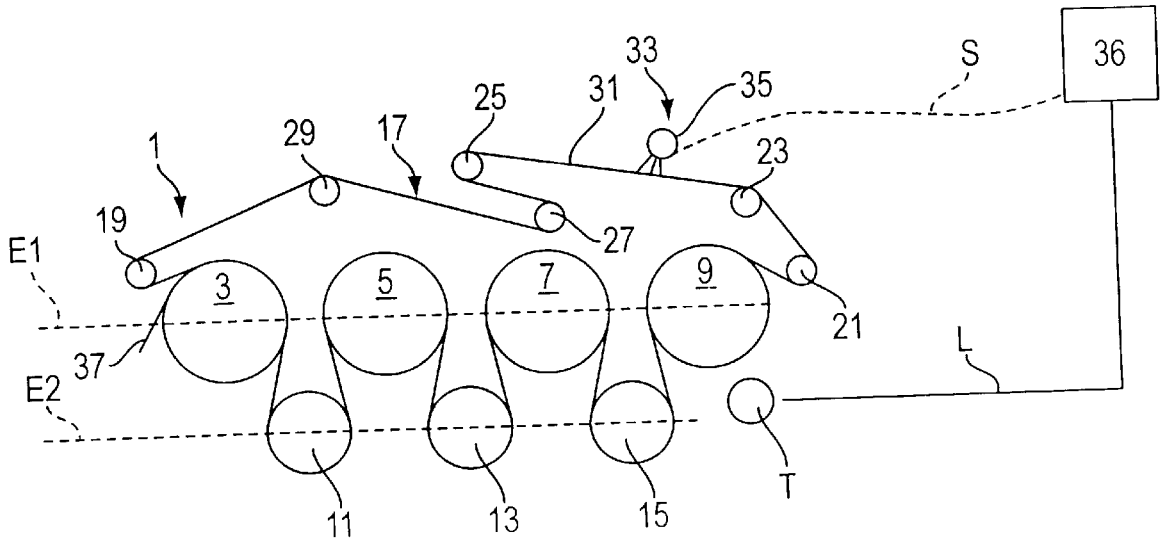
33
S
36
35
25
31
29
17
1
23
19
27
E1
3
5
7
9
21
37
L
E2
T
11
13
15

MOISTENING APPARATUS

CROSS-REFERENCE TO RELATED APPLICATION

The present invention claims priority under 35 U.S.C. § 119 of German Patent Application No. 196 30 446.6 filed Jul. 27, 1996, the disclosure of which is expressly incorporated by reference herein in its entirety.

BACKGROUND OF THE INVENTION

1. Field of the Invention

The present invention relates to a machine for manufacturing a web that includes a control device for activating the moistening apparatus in the event of a web break or tear. Further, the present invention relates to a method for moistening a conveyor belt of a machine which includes activating a moistening device in the event of a web break or tear.

2. Discussion of Background Information

Devices and processes similar in general to those generally described above are known in the art. In these devices and processes of the prior art, when a web breaks, a temperature of the dryer cylinders increases so that a desired cross-sectional moisture profile of the web cannot be adjusted. Thus, in many instances after a web breaks, the web is reconveyed with difficulty which increases the break period, i.e., prolongs the machine downtime.

SUMMARY OF THE INVENTION

Therefore, the present invention creates a moistening apparatus and a process for moistening a conveyor belt which does do not suffer from the above-noted disadvantages of the prior art.

In view of the foregoing, the present invention provides a machine for manufacturing a web that may include a drier section having a plurality of dryer cylinders and guide rolls, a transport belt that guides the web around the dryer cylinders and guide rolls in a meandering (or winding) path, a moistening device, and a controlling device, the controlling device activating the moistening apparatus in response to a web break. The characteristic feature of the moistening apparatus is that, when activated by the controlling device in response to a web break, fluid is fed to the dryer cylinders and, thus, influences the surface temperature of the cylinders. In this manner, it is also possible to prevent the undefined, i.e., unregulated, heating of the dryer cylinders caused by the missing web, so that a defined, i.e., regulated, temperature may be set after the broken or torn web has been rethreaded so that a desired cross-sectional moisture profile occurs.

In a preferred embodiment, the moistening apparatus includes a controlling device that controls the amount of fluid to be discharged by the moistening device as a function of the temperature of the dryer cylinders. This embodiment ensures that the surface temperature of the dryer cylinders is adjustable to a desired value so as to produce the desired moisture profile.

In a particularly preferred embodiment, the moistening apparatus disperses a variable amount of fluid across an entire width of the machine. This enables the machine to set lower temperatures in border areas, e.g., the ends, of the dryer cylinders to prevent overdrying the web edges. In this manner, a particularly even cross-sectional moisture profile may be established to prevent stresses within the web which could otherwise result in web breaks.

In a further preferred embodiment, the moistening apparatus may include a fluid discharging device associated with the transport belt to moisten the transport belt. The moistening apparatus can preferably be located on a returning strand of the transport belt and, therefore, may be located outside the area affected by parts of the material web that may fall out of the drier section after the web break. Accordingly, material residues do not precipitate, in particular, on the fluid discharging devices. Thus, the fluid discharging device can produce an even fluid discharge in moistening of the conveyor belt.

Still further, the present invention may be directed to a process for moistening a dryer section in which a moistening apparatus is activated in the event of a web break. The process provides that, in the event of a web break or tear, the moistening apparatus is activated to adjust the temperature of the dryer cylinders. In this manner, a desired moisture profile of the web can thus be set.

In a preferred embodiment of the process of the present invention, the process adjusts an amount of fluid discharged by the moistening apparatus, preferably, e.g. as a function of the temperature of the dryer cylinders. Thus, the process may be particularly sensitive to temperature changes within the dryer section, so that the moisture profile of the web can be predicted or determined with precision.

A particularly preferred embodiment of the process provides controlling discharge fluid across a width of the transport belt. For instance, the process may provide discharging more fluid in border areas of the transport belt to correspondingly cool the border areas of the dryer cylinders to a greater extent. Thus, an overdrying of the border areas of the web, as well as uneven sheet stresses, may be prevented.

Accordingly, the present invention may be directed to a machine for manufacturing a web. The machine may include a dryer section having a plurality of dryer cylinders and a plurality of guide rolls, a transport belt that guides the web through the dryer section in a meandering path, a moistening apparatus, and a control device including a device for detecting a web break and a device that activates the moistening apparatus to cool the dryer cylinders in response to the detected web break.

According to another feature of the present invention, the control device may include a device for regulating an amount of fluid discharged by the moistening apparatus.

According to another feature of the present invention, the amount of fluid discharged may be regulated as a function of a temperature of the dryer cylinders.

According to still another feature of the present invention, the control device may variably regulate the fluid amount discharged across the width of the dryer section. Further, the moistening apparatus may include at least one fluid discharging device extending across the width of the drier section. Still further, the at least one fluid discharging device may include at least one pipe having a nozzle opening.

According to a further feature of the present invention, the at least one fluid discharging device may be directed toward the transport belt to moisten the transport belt.

According to another feature of the present invention, the at least one fluid discharging device may be located adjacent a returning strand of the transport belt.

According to a still further feature of the present invention, the web may include one of paper and cardboard.

The present invention may be directed to a process for moistening a transport belt of a machine for manufacturing a web. The machine may include a dryer section having at least one dryer cylinder, and the process may include detecting a web break and activating a moistening device in response to the detected web break.

According to another feature of the present invention, the process may include adjustably discharging an amount of fluid from the moistening device. Further, the adjustable discharging of the amount of fluid may be a function of a temperature of the at least one dryer cylinder.

According to another feature of the present invention, the process may include controlling an amount of fluid discharged from the moistening apparatus across a width of the transport belt.

The present invention may also be directed to a moistening apparatus for use in a dryer section of a machine for manufacturing a web. The dryer section may include a plurality of dryer cylinders, a plurality of guide rolls, and a transport belt guided in a winding path and alternatingly around the dryer cylinders and the guide rolls and guided through a return path between an end of the dryer section and a beginning of the dryer section. The moistening apparatus may include at least one sensor positioned adjacent a surface of at least one of the plurality of dryer cylinders to detect one of a moisture profile of the web and a web break, a moisture discharge device, and a control device coupled to the at least one sensor and coupled to the moisture discharge device. The control device may actuate the moisture discharge device either to adjust the moisture profile of the web or to cool the plurality of dryer cylinders in response to the web break.

According to another feature of the present invention, the at least one sensor may include a plurality of sensors positioned along a length of the at least one of the plurality of dryer cylinders.

According to another feature of the present invention, the moisture discharge device may include a plurality of nozzles distributed across the transport belt. Further, the at least one sensor may include a plurality of sensors positioned along a length of the at least one of the plurality of dryer cylinders and each of the plurality of sensors may be associated with a respective nozzle through the control device.

According to a further feature of the present invention, the moisture discharge device may be positioned adjacent the transport belt in the return path.

The present invention may also be directed to a method for cooling a plurality of dryer cylinders in a dryer section of a web manufacturing machine in response to a web break. The dryer section may include a plurality of dryer cylinders, a plurality of guide rolls, and a transport belt guided in a winding path alternatingly around the dryer cylinders and the guide rolls and guided through a return path between an end of the dryer section and a beginning of the dryer section. The method may include detecting a web break, actuating the moistening device to moisten the transport belt, and cooling the plurality of dryer cylinders via contact with the moistened transport belt.

According to another feature of the present invention, the detecting of the web break may include monitoring a temperature of at least one of the plurality of dryer cylinders and determining that the monitored temperature exceeds a threshold value. A temperature beyond the threshold value is indicative of a web break.

According to yet another feature of the present invention, the detecting of the web break may include monitoring a temperature at discrete locations along a length of the at least one of the plurality of dryer cylinders and the actuating of the moistening device may include individually controlling a plurality of nozzles positioned at discrete locations across the transport belt in accordance with the monitored temperature. Further, the method may include detecting a moisture profile of the web and adjusting the moisture profile through the individual control of the plurality of nozzles.

Other exemplary embodiments and advantages of the present invention may be ascertained by reviewing the present disclosure and the accompanying drawing.

BRIEF DESCRIPTION OF THE DRAWINGS

The present invention may be further described in the detailed description which follows, in reference to the noted drawing by way of non-limiting example of a preferred embodiment of the present invention, and wherein:

The FIGURE illustrates a dryer section in a machine for manufacturing a web.

DETAILED DESCRIPTION OF THE PREFERRED EMBODIMENTS

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawing FIGURE making apparent to those skilled in the art how the invention may be embodied in practice.

While the present application makes particular reference to a machine for manufacturing webs, e.g., paper or endless cardboard, the features of the present invention are equally applicable in other machines utilized for similar application. Accordingly, the present application should not be construed as limited to the application of the preferred embodiment discussed herein.

The schematic diagram illustrated in the FIGURE shows a single row dryer section 1 having a plurality of dryer cylinders 3, 5, 7 and 9 and a plurality of guide rolls 11, 13, and 15. The centers of dryer cylinders 3, 5, 7, and 9 may be arranged in an imaginary plane E1 and the centers of guide rolls 11, 13 and 15 may be arranged in an imaginary plane E2. Plane E2 may be positioned parallel to, and spaced from, plane E1. Further, guide rolls 11, 13, and 15 may spatially located between gaps formed between adjacent dryer cylinders.

A transport (conveyor) belt 17 may be successively guided around the dryer cylinders and the guide rolls in a meandering or winding path. Transport belt 17 may be guided onto a first dryer cylinder 3 via a deflection roll 19 and guided away from a last dryer cylinder 9 via a deflection roll 21. A returning strand 31 of transport belt 17 may be guided back to first dryer cylinder 3 via a suitable plurality of additional deflection rolls, e.g., deflection rolls 23, 25, 27 and 29. Further, transport belt 17 may be tensioned or stressed in a region of deflection rolls 25 and 27. Transport belt 17 may be, e.g., a felt belt formed to be similar in general to those disclosed, e.g., in U.S. Pat. No. 5,569,358, U.S. Pat. No. 5,591,305, or U.S. Pat. No. 5,360,660. The tensioning of transport belt 17 may be similar in general to that disclosed, e.g., in U.S. Pat. No. 5,587,052.

A moistening apparatus 33 may be provided adjacent a portion of returning strand 31. Moistening apparatus 33 may be equipped with a fluid discharging device having at least one pipe 35. Pipe 35 may preferably extend across an entire width of the machine or the dryer section, and, in particular, across the width of transport belt 17. Pipe 35 may be provided with nozzle opening directed toward transport belt 17 of returning strand 31 to discharge fluid to be sprayed onto transport belt 17.

Further, moistening apparatus 33 may be provided with a controlling device 36 for regulating the fluid discharging device or pipe 35 via a control line S (shown as a dotted line). Controlling device 36 may, e.g., act on a valve device (not shown) to adjust an amount of fluid supplied to pipe 35. Moistening apparatus 33 may vary the amount of fluid discharged across the width of dryer section 1 or transport belt 17, e.g., via variably controllable and individually operable nozzles of pipe 35 or variably applying the fluid supply to the individual nozzles across the width of transport belt 17 pipe. The nozzles and/or valve device may be similar in general to those disclosed, e.g., in U.S. Pat. No. 5,595,632.

Moistening apparatus 33 may be coupled to a fluid reservoir (not shown) and may include at least one supply pump that may supply a pressurized fluid to pipe 35. The fluid supplied to pipe 35 may be regulated by valve devices (not shown) of conventional design. It may also be desired to vary the pump capacity, e.g., via controlling device 36, and, therefore, the fluid volume flow. If necessary, several pumps may be utilized to supply pipe sections that may be distributed across the width of dryer section 1. Finally, it is also conceivable to provide, e.g., in the region of returning strand 31, several fluid discharging devices or pipes 35 spaced from each other at a distance from each other.

As shown in the FIGURE, by positioning moistening apparatus 33 within the region of returning strand 31, remains or portions of web 37 which may be strewn about dryer section 1, e.g., due to a web break or tear, cannot enter the region of pipe 35 or obstruct or clog the nozzles. Thus, cleaning operations in the region of moistening apparatus 33 are not necessary in the event of a web break.

A temperature sensor T may be positioned adjacent or near the surface of at least one of the dryer cylinders, e.g., last dryer cylinder 9. An output signal of temperature sensor T may be sent to controlling device 36 over a line L, which may be associated with the temperature monitored dryer cylinder. For example, at a beginning portion of dryer section 1, the measured temperature may be, e.g., between approximately 55° C. and 100° C., and at an end portion of dryer section 1, the measured temperature may be, e.g., between approximately 110° C. and 150° C. However, the detected temperatures depend upon the type of material being guided through dryer section 1, i.e., the detected temperatures will generally be higher for thicker materials, e.g., cartons. Controlling device 36 may provide an amount of discharge fluid that varies as a function of the temperature of the dryer cylinders so a preferred temperatures may be maintained. The temperature of belt 17 should normally be, e.g., between approximately 50° C. and 90° C. It is noted that, if the controlling device was not utilized, during a web break, the temperature of transport belt 17 would increase to, e.g., approximately 120° C., and the temperature of the dryer cylinders would increase to, e.g., approximately 150° C.

Further, it is also possible to provide different temperature sensors across the width of the dryer cylinders 3, 4, 7 and 9, in order to sense the cross-sectional temperature profile of the dryer cylinders and, as a function thereof, to apply the fluid to the conveyor belt 17.

The cross-sectional moisture profile of transport belt 17 may, thus, be precisely adjusted by moistening apparatus 33. By adjusting the moisture present in transport belt 17, the moisture content of a web 37 may be correspondingly adjusted when guided through the dryer section via transport belt 17.

Web 37 may be guided through dryer section 1 in such a manner that it lies outside of transport belt 37 when guided around guide rolls 11, 13 and 15 and it lies against the surface of dryer cylinders 3, 5, 7 and 9 when guided around the dryer cylinders. To avoid a lifting of web 37 when guided around guide rolls 11, 13, and 15, the guide rolls may include suction devices generally utilized in the art for this purpose, as disclosed, e.g., in U.S. Pat. No. 5,015,336.

During operation, controlling device 36 may adjust a moisture profile of web 37 by actuating individual nozzles of moistening apparatus 33 which may be distributed across transport belt 17. In this manner, a cross-sectional moisture profile of web 37 may be adjusted, as discussed above.

Controlling device 36, further, activates moistening apparatus 33 during a web break so that a cooling of dryer cylinders 3, 5, 7 and 9 may be ensured with an appropriately wetted transport belt 17. That is, under normal operation, the moisture in web 37 cools the heated dryer cylinders. Once web 37 breaks or tears, the moisture necessary to cool the dryer cylinders is lost, thus, moisture apparatus 33 is actuated to supplement the moisture to prevent overheating and damage to the dryer cylinders. In this manner, the temperature of dryer cylinders 3, 5, 7 and 9 may remain, or be maintained, at a desired value even after a web break. Thus, once the web 37 has been rethreaded through dryer section 1 following the web break or tear, because of the maintenance of the temperature of the dryer cylinders, a desired moisture profile of the rethreaded web may be produced.

Because different sections of pipe 35, or its nozzles, may be selectively controllable by controlling device 36, a cross-sectional moisture profile of transport belt 17 and, therefore, a cross-sectional temperature profile of dryer cylinders 3, 5, 7 and 9 may be likewise adjusted, a defined cross-sectional moisture profile of web 37 may result after dryer section 1 is reopened following the web break.

The process for moistening transport belt 17 of the dryer section 1 may include activating moistening apparatus 33 in the event of, or as a result of, a break or tear in web 37. In this manner, the surface temperatures of dryer cylinders 3, 5, 7 and 9 may be maintained at a preferred or desired temperature even after web 37 breaks and stops cooling the dryer cylinders with the web moisture. Further, the amount of fluid necessary for cooling the dryer cylinders to the preferred or desired temperature may be determined empirically. That is, preferably the fluid amount may be adjusted as a function of the temperature of the dryer cylinders. At least one temperature sensor T may be provided to sense the temperature of the dryer cylinders, and, preferably, a plurality of temperature sensors are positioned across the width of one or more dryer cylinders, so as to sense or determined a cross-sectional temperature profile of the dryer cylinder(s). In this way, a cross-sectional moisture profile of transport belt 17 may be determined and maintained by controlling device 36 and the pipe 35. Thus, the temperature of the dryer cylinders may be maintained at a certain value even in the event of web breaks so that a cross-sectional moisture profile of web 37 may be ensured upon returning the machine to service. Accordingly, the process of the present invention may enable avoidance of certain stresses within web 37.

In view of the foregoing, it is apparent that moistening apparatus 33 can be utilized, not only single-row dryer sections 1, but in any suitable dryer section in accordance with the features of the present invention. For example, it is within the purview of the present invention that the moistening apparatuses of the present invention may be utilized in, for example, double-row dryer sections, e.g., similar in general to that disclosed in U.S. Pat. No. 5,248,390. Further, separate moistening apparatuses may be associated with each of the upper and lower transport belts of such a dryer section. Further, the controlling device can be developed so that the temperatures of the upper and lower rows of dryer cylinders may be sensed or determined separately. Accordingly, a moisture profile or cross-sectional moisture profile of both the upper and lower transport belts may be separately adjusted.

Further, all features of the moistening apparatus, in particular, the possibility to discharge various fluid amounts across the width of the conveyor belt, can also be applied to double-row drier aggregates.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed is:

1. A machine for manufacturing a web comprising:

a dryer section having a plurality of dryer cylinders and a plurality of guide rolls;

a transport belt that guides the web through the dryer section in a meandering path;

a moistening apparatus; and a control device including a device for detecting a web break and a device that activates the moistening apparatus to cool the dryer cylinders in response to the detected web break.

2. The machine according to claim 1, the control device further including a device for regulating an amount of fluid discharged by the moistening apparatus.

3. The machine according to claim 1, wherein the amount of fluid discharged is regulated as a function of a temperature of the dryer cylinders.

4. The machine according to claim 1, wherein the control device variably regulates the fluid amount discharged across the width of the dryer section.

5. The machine according to claim 4, the moistening apparatus including at least one fluid discharging device extending across the width of the drier section.

6. The machine according to claim 5, the at least one fluid discharging device including at least one pipe having a nozzle opening.

7. The machine according to claim 5, the at least one fluid discharging device being directed toward the transport belt to moisten the transport belt.

8. The machine according to claim 5, the at least one fluid discharging device being located adjacent a returning strand of the transport belt.

9. The machine according to claim 1, the web comprising one of paper and cardboard.

10. A process for moistening a transport belt of a machine for manufacturing a web, the machine including a dryer section having at least one dryer cylinder, the process comprising:

detecting a web break; and activating a moistening device in response to the detected web break.

11. The process according to claim 10, further comprising adjustably discharging an amount of fluid from the moistening device.

12. The process according to claim 11, the adjustable discharging of the amount of fluid being a function of a temperature of the at least one dryer cylinder.

13. The process according to claim 10, further comprising controlling an amount of fluid discharged from the moistening apparatus across a width of the transport belt.

14. A moistening apparatus for use in a dryer section of a machine for manufacturing a web, the dryer section including a plurality of dryer cylinders, a plurality of guide rolls, and a transport belt guided in a winding path and alternatingly around the dryer cylinders and the guide rolls and guided through a return path between an end of the dryer section and a beginning of the dryer section, the moistening apparatus comprising:

at least one sensor positioned adjacent a surface of at least one of the plurality of dryer cylinders to detect one of a moisture profile of the web and a web break;

a moisture discharge device; and a control device coupled to the at least one sensor and coupled to the moisture discharge device, wherein the control device actuates the moisture discharge device either to adjust the moisture profile of the web or to cool the plurality of dryer cylinders in response to the web break.

15. The moistening apparatus according to claim 14, the at least one sensor comprising a plurality of sensors positioned along a length of the at least one of the plurality of dryer cylinders.

16. The moistening apparatus according to claim 14, the moisture discharge device comprising a plurality of nozzles distributed across the transport belt.

17. The moistening apparatus according to claim 16, the at least one sensor comprising a plurality of sensors positioned along a length of the at least one of the plurality of dryer cylinders; and each of the plurality of sensors is associated with a respective nozzle through the control device.

18. The moistening apparatus according to claim 14, the moisture discharge device positioned adjacent the transport belt in the return path.

19. A method for cooling a plurality of dryer cylinders in a dryer section of a web manufacturing machine in response to a web break, the dryer section including a plurality of dryer cylinders, a plurality of guide rolls, and a transport belt guided in a winding path and alternatingly around the dryer cylinders and the guide rolls and guided through a return path between an end of the dryer section and a beginning of the dryer section, the method comprising:

detecting a web break;

actuating the moistening device to moisten the transport belt; and cooling the plurality of dryer cylinders via contact with the moistened transport belt.

20. The method according to claim 19, the detecting of the web break comprising:

monitoring a temperature of at least one of the plurality of dryer cylinders; and determining that the monitored temperature exceeds a threshold value, wherein at a temperature beyond the threshold value is indicative of a web break.

21. The method according to claim 19, the detecting of the web break comprising monitoring a temperature at discrete locations along a length of the at least one of the plurality of dryer cylinders; and the actuating of the moistening device comprising individually controlling a plurality of nozzles positioned at discrete locations across the transport belt in accordance with the monitored temperature.

22. The method according to claim 21, further comprising:

detecting a moisture profile of the web; and adjusting the moisture profile through the individual control of the plurality of nozzles.

23. A moistening apparatus for use in a dryer section of a machine for manufacturing a web, the dryer section including a plurality of dryer cylinders, a plurality of guide rolls, and a transport belt guided in a winding path and alternatingly around the dryer cylinders and the guide rolls and guided through a return path between an end of the dryer section and a beginning of the dryer section, the moistening apparatus comprising:

at least one sensor positioned adjacent a surface of at least one of the plurality of dryer cylinders and being adapted to detect a web break;

a moisture discharge device; and a control device coupled to the at least one sensor and coupled to the moisture discharge device, the control device being adapted to actuate the moisture discharge device to cool the plurality of dryer cylinders in response to the web break.

24. The moistening apparatus in accordance with claim 23, the at least one sensor being further adapted to detect a moisture profile of the web, and the control device being further adapted to adjust the moisture profile of the web.

* * * * *